United States Patent [19]

Laughlin et al.

[11] Patent Number: 4,470,453

[45] Date of Patent: Sep. 11, 1984

[54] PRIMARY SURFACE FOR COMPACT HEAT EXCHANGERS

[75] Inventors: Robert M. Laughlin, Kenmore, Wash.; Paul L. Hoffman, Stratford, Conn.

[73] Assignee: Avco Corporation, Stratford, Conn.

[21] Appl. No.: 409,426

[22] Filed: Aug. 19, 1982

[51] Int. Cl.[3] ..... F28F 3/04; F28D 9/00

[52] U.S. Cl. ..... 165/166; 165/167

[58] Field of Search ..... 165/166, 167

[56] References Cited

U.S. PATENT DOCUMENTS

| | | | |
|---|---|---|---|
| 2,596,642 | 5/1952 | Boestad | 165/166 |
| 2,940,736 | 6/1960 | Ödman | 165/166 |
| 3,165,152 | 1/1965 | Jones | 165/166 |
| 3,424,240 | 1/1969 | Stein et al. | 165/166 |
| 3,498,372 | 3/1970 | Patten et al. | 165/166 |
| 3,759,323 | 9/1973 | Dawson et al. | 165/166 |
| 3,783,090 | 1/1974 | Andersson et al. | 165/166 |
| 4,396,058 | 8/1983 | Kurschner et al. | 165/10 X |

FOREIGN PATENT DOCUMENTS

| | | | |
|---|---|---|---|
| 1486919 | 9/1977 | United Kingdom | 165/167 |
| 2091407 | 7/1982 | United Kingdom | 165/166 |

*Primary Examiner*—Sheldon J. Richter
*Attorney, Agent, or Firm*—Ralph D. Gelling

[57] ABSTRACT

A heat exchange apparatus having a plurality of plates through which heat is exchanged from a first gas to a second gas is provided with a plurality of plates having first and second opposing patterns. Each of the opposing patterns is provided with a plurality of sinusoidally varying surface strips and a plurality of spacing ridges between the surface strips, whereby the second gas flows in a generally sinusoidal path in a first direction along a first side of the first and second patterns between the first and second plates and the first gas flows in a generally sinusoidal path in a direction opposite the first direction along the other side of the first and second plates. The plurality of spacing ridges on the second pattern are disposed relative to the spacing ridges on the first pattern such that the spacing ridges on the second pattern lie along a line substantially in the middle of the surface strips of the first pattern, and vice versa. The first and second patterns are provided with sealing ridges in abutting relationship, the sealing ridges so disposed to provide an inlet and outlet for the second gas when the plates are mounted in the heat exchange apparatus.

16 Claims, 10 Drawing Figures

PRIMARY SURFACE FOR COMPACT HEAT EXCHANGERS

The Government has rights in this invention pursuant to Contract No. DAAK30-78-C-0054 awarded by the Department of the Army.

BACKGROUND OF THE INVENTION

The present invention relates to a new and improved primary surface for use in a corrugated plate type heat exchanger, and more particularly a heat exchanger device made up of a plurality of plates of relatively thin material, so formed and stacked as to provide heat transfer through the plates to and from a series of alternate flow passages formed between the stacked, alternate plates.

U.S. Pat. No. 3,424,240 to Stein et al., assigned to the assignee of the present invention, discloses a heat exchanger device made up of a plurality of plates formed in two types of configurations stacked alternately in pairs to form the stack. The two types of plates have spaced openings therethrough which are aligned when stacked to form inlets and outlets to and from one of the series of longitudinal flow passages in the stacked plates. The first type of plates is preferrably formed with a pattern of corrugations between the spaced openings extending across the plates in a radially outward direction thus providing channel forming, generally parallel wave formations on both surfaces thereof. On the other hand, the other of the two types of plates is formed with a pattern of generally parallel corrugations extending circumferentially along the plates between the spaced openings therethrough, the pattern of corrugations on the second type of plates extending transversely to the corrugations provided on the first type of plates when the two different types of plates are positioned adjacent one another to form a construction pair with the spaced openings in alignment. The aligned openings in the first and second types of plates are sealed together by welding or brazing.

When the first and second types of plates are placed adjacent each other, a grid of touching points is formed between each pair of adjacent plates by the intersection of the longitudinal and transverse ridges from the alternate plates. A plurality of flow passages through which a gas or air travels are established between the touching points on the grid. When so formed, however, a contraction and expansion of the flow passage at each transverse ridge is inherently produced, the flow passages varying in area along the direction of flow to thereby promote thermal mixing within the passages and enhance the rate of heat transfer.

However, by reducing the pressure losses associated with expanding and contracting passages, a primary surface heat exchanger may achieve a higher ratio of heat transfer parameter to friction factor.

SUMMARY OF THE INVENTION

It is therefore an object of the invention to provide an improved primary surface for compact heat exchangers which provides a reduced pressure drop between input port and output ports, and increases the rate of heat transfer.

It is a further object of the invention to provide a heat exchange apparatus which employs an improved primary surface through which heat is transferred, the improved primary surface reducing the pressure drop between input and output ports and increasing the rate of heat transfer.

In accordance with the first aspect of the invention, a plate adapted for use in a heat exchange apparatus of the type having a plurality of such plates through which heat is exchanged from a first gas to a second gas, includes at least one pattern having a plurality of generally sinusoidally varying surface strips and a plurality of spacing ridges between the surface strips. The pattern is designed to produce a generally sinusoidal flow of the first and second gases in opposite directions on opposite sides of the plate. In one case, the plurality of spacing ridges are disposed such that the plurality of surface strips are substantially equal in width, to produce a type A pattern. In the other case, the spacing ridges may be disposed such that all but two of the plurality of surface strips are substantially equal in width, the width of the remaining two surface strips being approximately one half the width of the other strips and disposed on opposite sides of the surface strips of substantially equal widths to produce a type B plate.

First and second sealing ridges are disposed on opposite sides of the surface patterns parallel to the spacing ridges, for both type A and type B patterns. The first sealing ridge extends from one end of each pattern and terminates short of the other end of the pattern to provide an inlet for the second gas. The second sealing ridge extends from the other end of the pattern and terminates short of the one end of the pattern to provide an outlet for the second gas. The A and B type patterns further comprise third and fourth sealing ridges disposed on opposite ends of the plurality of surface strips substantially perpendicular to the spacing ridges.

In accordance with a second aspect of the invention, a heat exchange apparatus having a plurality of plates through which heat is exchanged from a first gas to a second gas is provided with at least first and second plates respectively having first and second opposing patterns. Each of the opposing patterns is provided with a plurality of generally sinusoidally varying surface strips and a plurality of spacing ridges between the surface strips, whereby the second gas flows in a generally sinusoidal path in a first direction along a first side of the first and second plates between the first and second plates and the first gas flows in a generally sinusoidal path in a direction opposite the first direction along the other side of at least one of the first and second plates. The plurality of spacing ridges on the second pattern are disposed relative to the plurality of spacing ridges on the first pattern such that the spacing ridges on the second pattern lie along a line substantially in the middle of the surface strips of the first pattern and the spacing ridges on the first pattern lie along a line substantially in the middle of the surface strips of the second pattern. The first and second patterns are further provided with the first and second sealing ridges as described in conjunction with the first aspect of the invention to provide an inlet and outlet for the second gas such that when the first and second of the plurality of plates are mounted in the heat exchange apparatus, the second gas flows from the inlet to the outlet between the first and second plates. The first and second patterns further include the third and fourth sealing ridges described above.

In accordance with a third aspect of the present invention, a heat exchange apparatus is provided with a plurality of plates of substantially uniform extent and of relatively thin material so formed and stacked as to provide heat transfer through the plates from a first gas to a second gas. The plates are of substantially identical size and are of two types, the first of which is formed with a central opening and an alternating arrangement of first surface patterns and ports, the second of which is formed with a central opening and an alternating arrangement of second surface patterns and ports, the first and second types of plates being stacked alternatively so as to place the ports and patterns in alignment, with surface patterns of the first type on plates of the first type being adjacent to surface patterns of the second type on plates of the second type adjacent thereto to form a plurality of opposing pattern pairs. Each of the first and second patterns in each pattern pair has a plurality of generally sinusoidally varying surface strips and a plurality of spacing ridges between the surface strips, whereby the second gas flows in a generally sinusodial path in a first direction along a first side of the first and second patterns between the first and second plates and the first gas flows in a generally sinusoidal path in a direction opposite the first direction along the other side of at least one of the first and second plates.

With more specific reference to the second and third aspects of the invention, the first and second plates abut each other such that the first and second patterns intersect at a grid of points which function to maintain the patterns a predetermined distance from each other. Also, the generally sinusoidal paths are of substantially constant cross-sectional area between the first and second patterns but have substantially varied shapes along the paths.

In accordance with a fourth aspect of the present invention, a heat exchange apparatus is provided with a plurality of plates through which heat is exchanged from a first gas to a second gas. At least first and second of the plurality of plates are respectively provided with first and second abutting and opposing patterns each having a generally sinusodially varying surface and a grid of support points adapted to maintain the first and second plates a predetermined distance from each other. The second gas flows in a generally sinusodial path in a first direction along a first side of the first and second plates between the first and second plates, while the first gas flows in a generally sinusodial path in a direction opposite the first direction along the other side of at least one of the first and second plates.

In accordance with a fifth aspect of the invention a heat exchange apparatus is provided with a plurality of plates through which heat is exchanged from a first gas to a second gas. At least first and second of the plurality of plates are respectively provided with first and second abutting and opposing patterns each having a generally sinusodially varying surface and means adapted to maintain the first and second plates a predetermined distance from each other. The second gas flows in a generally sinusodial path of substantially constant cross-sectional area but of varying shape in first direction along a first side of the first and second plates between the first and second plates. The first gas flows in a generally sinusoidal path of substantially constant cross-sectional area but of varying shape in a direction opposite the first direction along the other side of at least one of the first and second plates.

BRIEF DESCRIPTION OF THE DRAWINGS

These and other objects, aspects and embodiments of the invention will be described in more detail below with reference to the following drawing figures of which.

DETAILED DESCRIPTION OF THE PREFERRED EMBODIMENTS

The plates which employ the primary surfaces in accordance with the present invention are disposed in a compact heat exchanger of the type generally illustrated in FIG. 5, which will be explained in more detail below. Generally, the heat exchanger illustrated in FIG. 5, and those discussed above, provide for the transfer of heat from a first gas to a second gas, the first gas being exhaust gas from an engine, the second gas being compressed air, in the example of FIG. 5. The details of the individual surface patterns will first be described with reference to FIGS. 1–4.

Figure 1A:
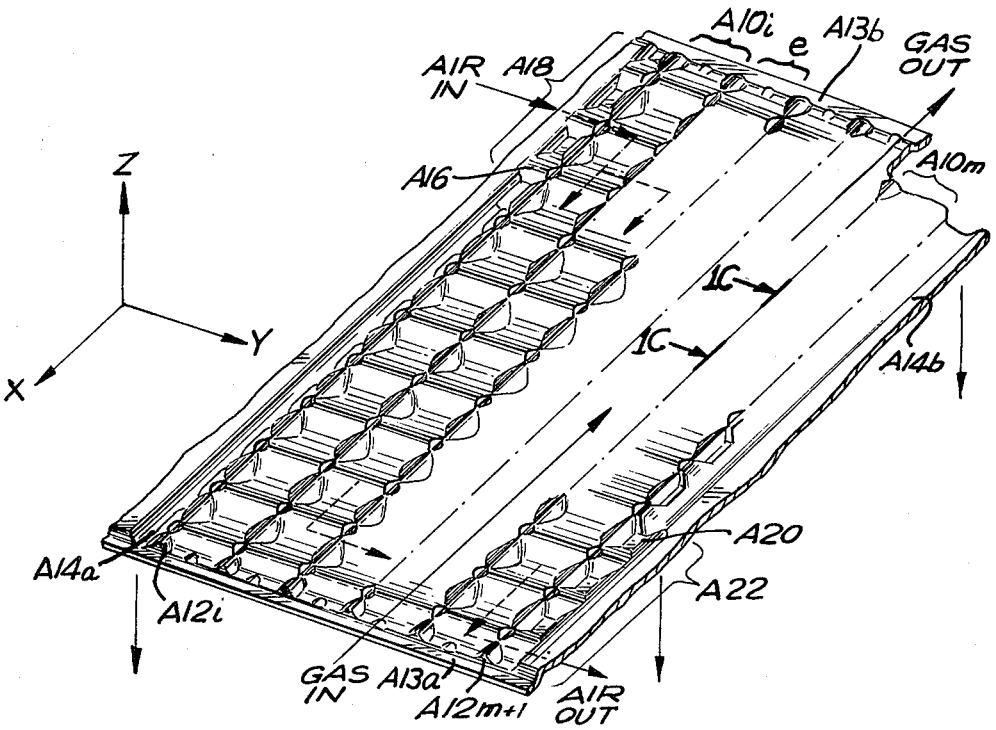
FIG. 1A is a detailed perspective view of the type A pattern employed on the plates disposed in the heat exchange apparatus in accordance with the present invention.
Figure 1B:
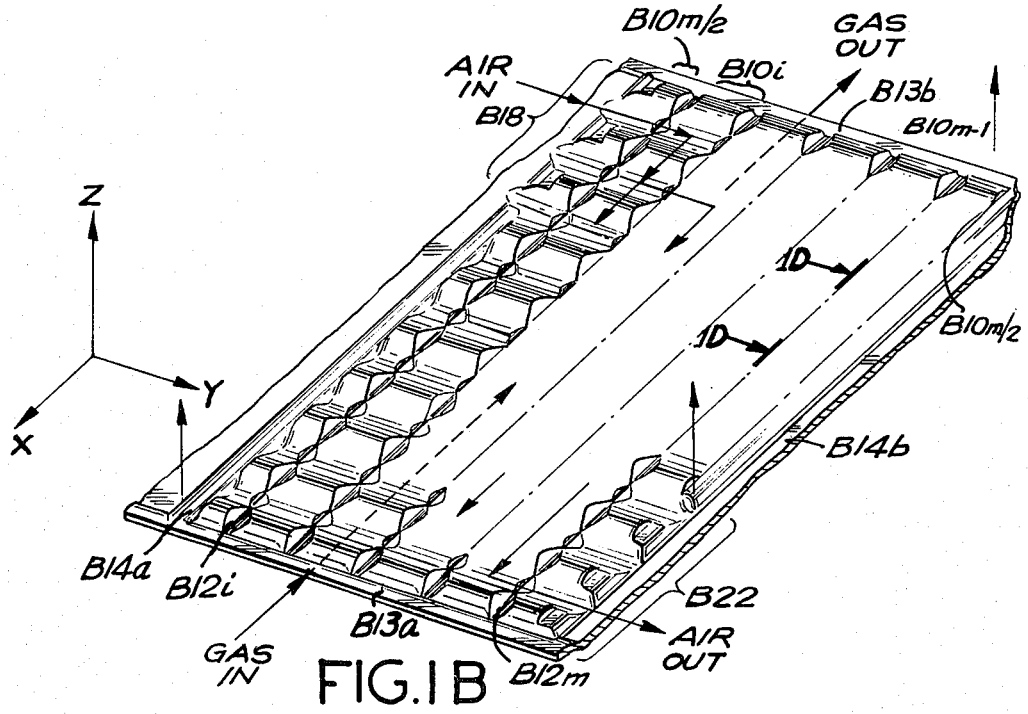
FIG. 1B is a detailed perspective view of the type B pattern employed on the plates used in the heat exchange apparatus in accordance with the present invention.

The primary surfaces for a compact heat exchanger are illustrated in FIGS. 1A and 1B. FIG. 1A illustrates what will be referred to as the primary surface pattern A, or the A pattern, while FIG. 1B illustrates what will be referred to as the primary surface pattern B, or the B pattern. The A pattern is generally rectangular and includes a plurality of strips A10*i*-A10*m* extending the length of the pattern along the X direction and having a width e in the Y direction. The vertical extent of each of the strips A10*i*-A10*m* in the Z direction varies approximately sinusoidally along the X direction, to provide generally sinusoidal paths of travel for the two gases, as will be explained in more detail below.

Disposed on either side of each of the strips A10*i*-A10*m* and contiguous therewith are an associated plurality of spacing ridges A12*i*-A12*m*+1. Disposed along the left and right edges of plate A in the X direction are sealing ridges A14*a* and A14*b*, respectively. Sealing ridge A14*a* is comprised of an indentation in a downward, or negative Z direction and extends from the front edge of the plate through the greater portion of the length of the plate to point A16, where a partial strip A18, is disposed to the left of primary ridge A12*i*. The discontinuation of the sealing ridge provides an air inlet below plate A at A18.

On the right-hand side of the A pattern, extending from the rear edge of the pattern to point A20, is sealing ridge A14*b* which provides an indentation in the downward, or negative Z direction. At point A20 however, sealing ridge A14*b* terminates, and a partial strip A22 is provided. The termination of the sealing ridge provides an air outlet below plate A at A22. Sealing ridges A14*a* and A14*b* are substantially identical in length, the only difference being that sealing ridge A14*a* begins at the front portion of the A pattern and terminates at point A16 in the proximity of the rear edge of the pattern, while sealing ridge A14*b* starts at the rear edge of the pattern and terminates at point A20 in the proximity of the front edge of the pattern. Finally, the A pattern is terminated front and back by sealing ridges A13*a* and A13*b*, respectively, both disposed in the same X—Y plane as sealing ridges A14*a* and A14*b*, the combination of sealing ridges A13*a*, A13*b*, A14*a* and A14*b* providing a border around the periphery of the pattern, except for air inlet A18 and air outlet A22.

With reference to FIG. 1B, the B pattern, which is essentially identical to the A pattern, except for the important differences noted below, is shown. In referring to the various portions of the B pattern, reference numerals identical to those used in discussing the A pattern will be used when referring to the associated portions of the B pattern, the prefixes "A" and "B" being used to designated the A or B patterns, respectively.

One of the major differences between the A and B patterns is that the B pattern is provided with full strips B10*i*-B10*m*−1, one less full strip than that contained in pattern A. The extra strip B10*m* is divided into two strips B10*m*/2 on either side of strips B10*i*-B10*m*−1, each of the strips B10*m*/2 being one-half the width of the strips B10*i*-B10*m*−1. As will be seen in greater detail below, this disposition of strips B10*m*/2 causes an interleaved pattern of ridges A12*i*-A12*m*+1 and B12*i*-B12*m*, when the A and B patterns are placed on top of each other when mounted in the compact heat exchanger.

Figure 1C:
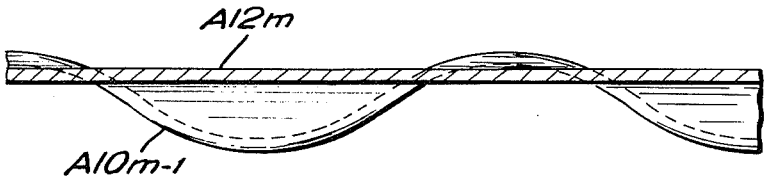
FIG. 1C is a cross-section view of the type A pattern taken through section 1C—1C in FIG. 1A.
Figure 1D:
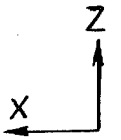
FIG. 1 is a cross-section view of the type B pattern taken through section 1D—1D of FIG. 1B.
Figure 1D:
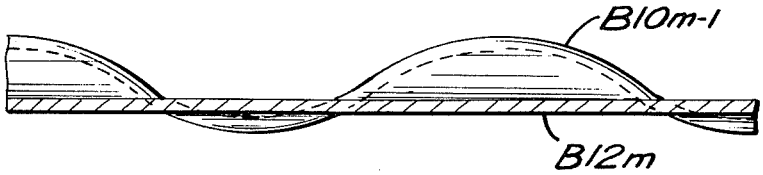
Figure 3:
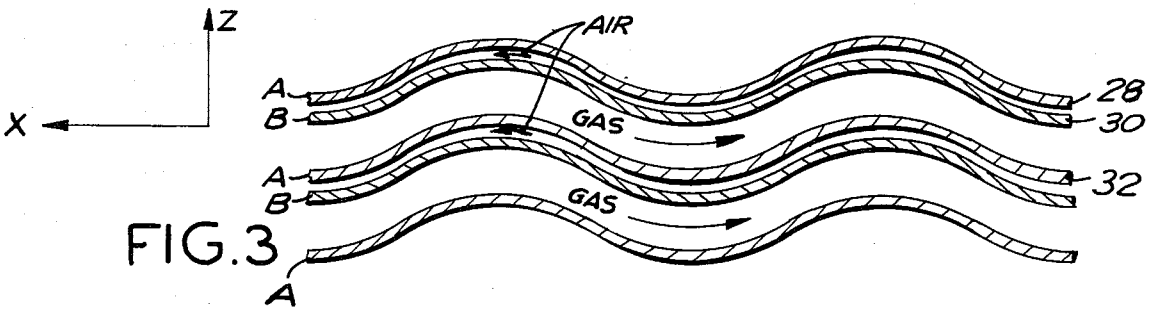
FIG. 3 is a cross-section view of a plurality of type A and B patterns in stacked relationship as disposed within the heat exchange apparatus in accordance with the present invention, taken through section 3—3 of FIG. 2.

Another major difference between the A and B patterns is the disposition of sealing ridges B13*a*, B13*b*, B14*a* and B14*b*, which provide upwardly extending protrusions, rather than the downwardly extending indentations as with pattern A. Pattern B is provided with air inlet B18 disposed in the same location along the left-hand edge of pattern B as that of air inlet A18 in pattern A. Similarly, pattern B is provided with air outlet B22 provided in the position corresponding to the associated air outlet A22 in pattern A. The generally sinusoidal variations in the Z direction along the X direction in strips A10*i*-A10*m* and B10*i*-B10*m* are essentially identical, and begin and end on the plates in the X direction such that the waves line up coherently, as best illustrated in FIG. 3, when the A and B patterns are placed adjacent to one another. The disposition in the Z direction of ridges A12*i*-A12*m*+1 relative to the sinusoidally varying paths in pattern A reflect the disposition in the Z direction of ridges B12*i*-B12*m* relative to the sinusoidally varying paths in pattern B. With reference to FIGS. 1C and 1D, illustrating the cross-section views taken through sections 1C—1C and 1D—1D, respectively, it can be seen that ridge A12*m* is positioned in the Z direction to be closer to the peaks of path A10*m*−1 than the valleys thereof, for example. This is in contrast to ridge B12*m*, which is positioned in the Z direction to be closer to the valleys of path B10*m*−1 than the peaks thereof. It should be noted that an inversion of one of the patterns of FIGS. 1C or 1D will produce the other of the patterns.

The A and B patterns illustrated in FIGS. 1A and 1B are adapted to be placed in abutting relationship when assembled in the heat exchanger. When so disposed, each of the four edges of patterns A and B will effectively be sealed together, by abutting pairs of sealing ridges 13*a*, 13*b*, 14*a*, 14*b*. Thus, the peripheries of the A and B patterns are effectively sealed except for those portions in which air inlets A18, B18 and A22 and B22 are disposed to provide respective air inlets and outlets to produce the air flow between the plates, as illustrated, from the air inlet to air outlet.

The A and B patterns shown in FIGS. 1A and 1B, effectively sealed about the edges except for the air inlet and air outlet, will hereinafter be referred to as a "pattern pair". When assembled in the heat exchanger, both on top of and on the bottom of the pattern pair shown in FIGS. 1A and 1B will be further pattern pairs. Adjacent pattern pairs are always disposed such that an A-B-A-B-A-B . . . sequence is always provided. The pattern pairs are stacked in abutting relationship, but the patterns from different pattern pairs will not be sealed about their peripheries since the sealing ridges between different pattern pairs are directed away from each other, thus allowing a gas flow in the X direction between adjacent pattern pairs, as shown in FIGS. 1A and 1B as a gas flow both above and below the pattern pair. The air flow and gas flow through the stack of plates will be described in greater detail below.

Figure 2:
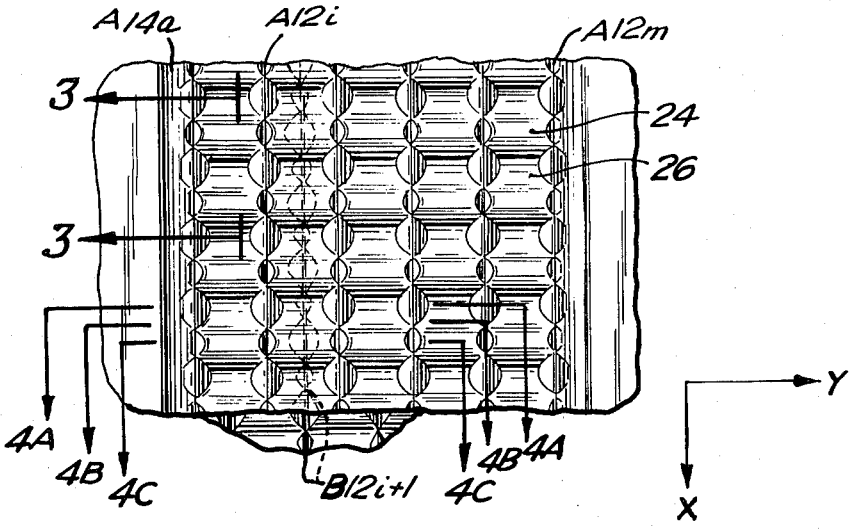
FIG. 2 is a top view of the type A pattern of FIG. 1A.

FIG. 2 is a top view of the pattern pair illustrated in FIGS. 1A and 1B. Shown therein is sealing ridge A14*a*, and spacing ridges A12*i*-A12*m*. Shown in dashed lines is ridge B12*i*+1 to illustrate the relationship between ridges on the A and B patterns. Also designated are "hills" 24 and "valleys" 26 along the sinusoidally varying strips A10*i*-A10*m* and the underlying strips B10*i*-B10*m*. Typical dimensions of the patterns may, for example, be approximately 0.362 inches between spacing ridges, approximately 0.330 inches in the X direction for a single sinusoidal cycle of the sinusoidal paths, and approximately 0.058 inches peak-to-peak along the Z direction for each path. The typical thickness of the plates on which the patterns are provided is approximately 0.008 inches. Many variations to the above dimensions will become apparent to those skilled in the art to produce slightly different effects as desired.

Section 3—3 of FIG. 2, taken along the X axis between spacing ridges A12*i* and B12*i*+1, is illustrated in FIG. 3. It can be seen that A pattern 28 and adjacent B pattern 30 provide a pattern pair since an air flow is established therebetween. Also shown is a pattern 32 from an adjacent pattern pair, which is in abutting relationship with B pattern 30. A gas path is provided as shown in the space between patterns 30 and 32.

Figure 4A:
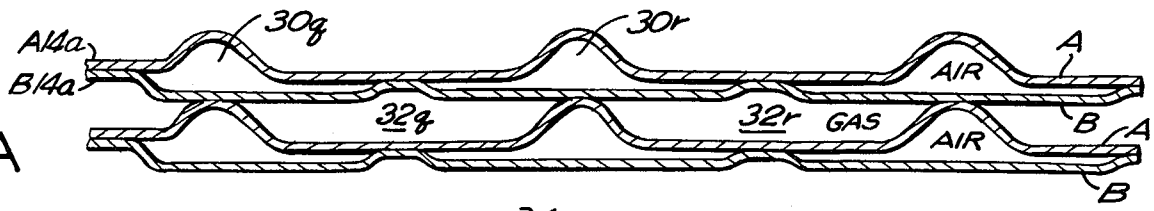
FIGS. 4A–4C are cross-section views of a plurality of type A and B patterns in stacked relationship as disposed in the heat exchange apparatus in accordance with the present invention, taken through sections 4A—4A through 4C—4C, respectively.
Figure 4B:
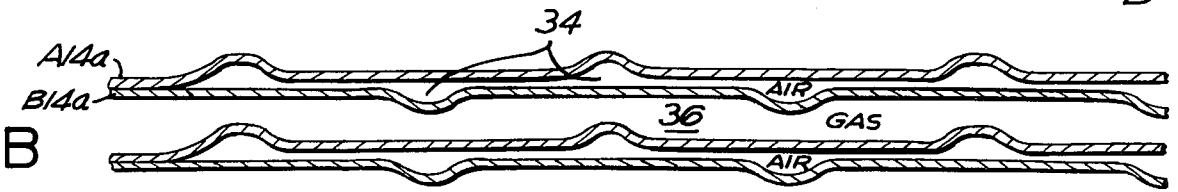
Figure 4C:
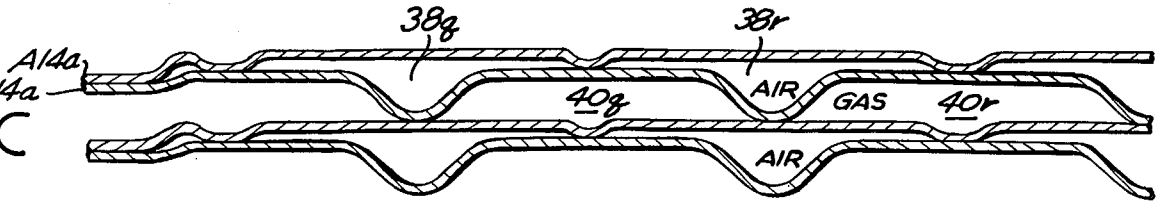

The sections 4A—4A, 4B—4B and 4C—4C, of FIG. 2, are illustrated in FIGS. 4A–4C, respectively. Section 4A—4A, taken through the nadir of one of the valleys 26, is shown in FIG. 4A. At the left-most portion of FIG. 4 it can be seen that sealing ridges A14*a* and B14*a* on the top pattern pair come into abuttment to seal the periphery of each pattern pair. Air which enters at the air inlet as shown in FIGS. 1A and 1B will occupy the air passageway 30 while gas occupys passageway 32.

At section 4A the airflow passage is split by spacing ridges B12*i* into channels 30*q*, 30*r* etc., and the gas passage 32 is split by spacing ridges A12*i* into channels 32*q*, 32*r*, etc. Section 4B—4B taken vertically through the series of plates at a location slightly closer toward the front of the plates than section 4A—4A is illustrated in FIG. 4B. Air passage 34 on FIG. 4B is the continuation of air passage 30 of FIG. 4A, and gas passage 36 on FIG. 4B is the continuation of gas passage 32 of FIG. 4A. Section 4C—4C taken through the highest point of the hill portions of the paths produces the situation illustrated in FIG. 4C. At section 4C the air-flow passage is split by spacing ridges A12*i* into channels 38*q*, 38*r*, etc., and the gas passage is split by spacing ridges B12*i* into channels 40*q*, 40*r*, etc. It will be appreciated that sections through the air and gas passageways, perpendicular to the direction of flow exhibit large variations in shape and small variations in area along the direction of flow. It should also be appreciated that each of the air and gas paths are continuous in the X direction and vary sinusoidally in the Z direction, as illustrated in FIG. 3, to thus provide parallel, sinusoidal air and gas flows in opposite directions, in order to produce the air flow from the air inlet to the air outlet between A and B patterns in a pattern pair as shown in FIGS. 1A and 1B, and the gas flow between different pattern pairs.

Thus, the strips A10*i*-A10*m* on the A plate are separated from the strips B10*i*-B10*m* on the B plate by the spacing ridges on each of the plates which function to form a grid of touching points between the plates as best illustrated in FIGS. 4A and 4C. An important difference between the present invention and that of the above-mentioned patent to Stein et al. is that the present invention provides essentially constant area flow passages through which gas or air flows in a cyclically or generally sinusoidal path established by the shape of the strips and modified by the spacing ridges. The shape of the strips superficially resembles a sine wave, and for brevity, the strips are referred to as being generally sinusodial. However, it is to be understood that neither the plate shape nor the gas or air paths are truly sinusodial, nor would any special merit attend the use of a sine wave. When the A and B plates are placed together to form flow passages, the spacing ridges from each plate slice into the flow passage at points of nearest approach of the opposing plate. In both the air and the gas passages, as the fluid moves between the plates it encounters an array or grid of spacing ridges which present themselves to the fluid stream as intermittent streamlined projections. The staggered or intermittent grid of projections acts to produce secondary flows which promote thermal mixing, thus enhancing the rate of heat transfer.

This is contrasted with the Stein et al. patterns which exhibit a significant degree of expansion and contraction of the flow passages at each transverse ridge to promote thermal mixing within the flow passages. The present invention thus provides a lower pressure drop due to less variation in the cross-section area of the flow paths. Also, heat transfer is higher because the cross-section, although of substantially constant area, is constantly changing shape to thus produce secondary flows which enhance the coefficient of surface heat transfer. Further, the approximately sinusodial flows will also increase heat transfer.

The flow passages just described provide a significant advance over the associated flows in the prior art heat exchangers, since:

(1) Pressure drop is lower because cross-section area variation is less;

(2) Heat transfer is higher because cross-section shape is constantly changing producing secondary flows which enhance the coefficient of surface heat transfer; and (3) The turning of the flow by the approximately sinusodial shape will also increase the heat transfer.

As a result, the stack produced using the above described patterns as more fully described below would exhibit a lower pressure drop across the patterns and an increased heat transfer.

The A and B type patterns may be arranged in a heat exchanger in a manner similar to that provided in the prior art such as the above-mentioned patent to Stein et al. With reference to FIG. 5, an "A" plate 200*a* is provided with a plurality of A type patterns 202 and input and output ports 115, 116, 117 . . . , as described above. Similarly, a "B" plate 200*b* is provided with a plurality of B type patterns 204 and the corresponding input and output ports 115, 116, 117, . . . The A and B type patterns on plates 200*a* and 200*b* are oriented with the sealing ridges of all of the patterns facing each other such that associated A and B patterns on plates 200*a* and 200*b* form a pattern pair as described above, plates 200*a* and 200*b* forming a plate pair, the outer and inner circumferences of plates 200*a* and 200*b* being connected to each other. An adjacent plate pair, 201*a* and 201*b* is connected to plate pair 200*a* and 200*b* by connecting the perimeters of the input and output ports as described above. Of course, the sealing ridges on the B and A patterns of plates 200*b* and 201*a*, respectively, face away from each other, since they are contained in separate plate pairs.

Figure 5:
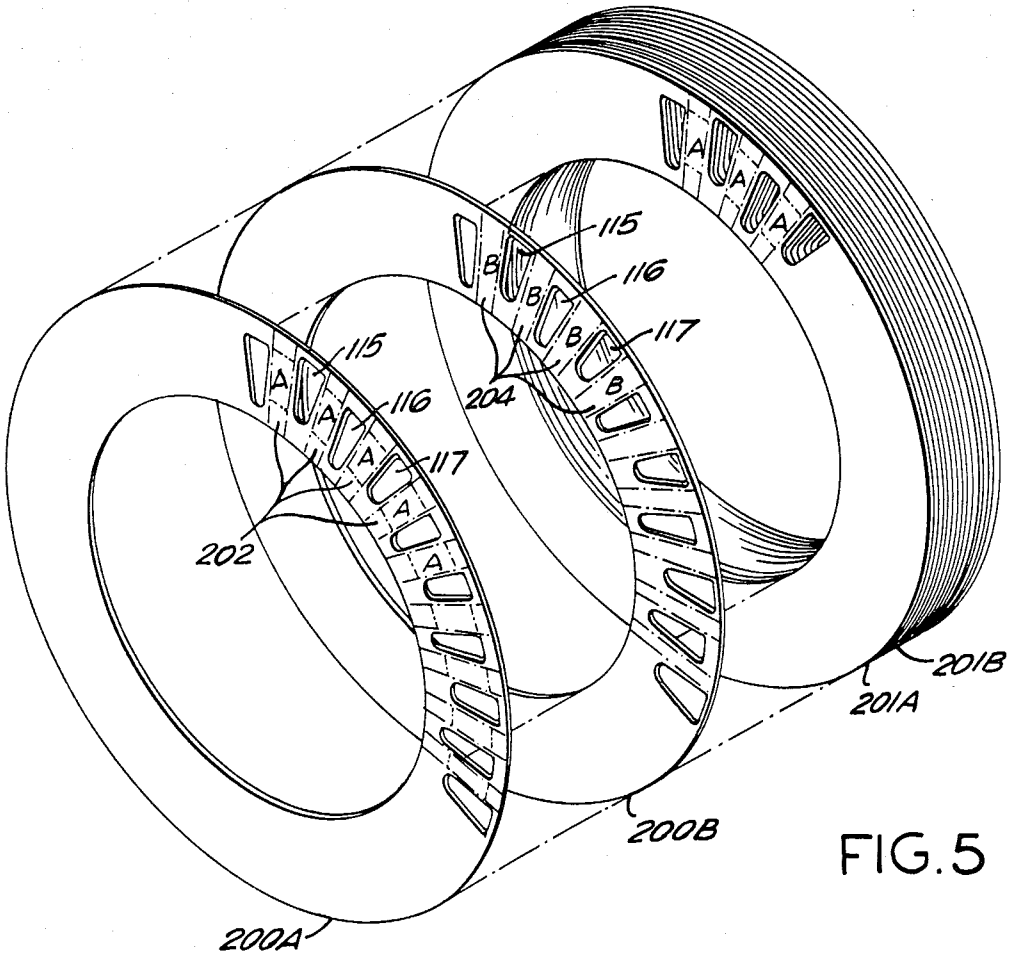
FIG. 5 is a partially exploded view of a portion of the heat exchange apparatus in accordance with the present invention.

The air flows associated with the heat exchanger illustrated in FIG. 5 are similar to those described in the Stein et al. patent, and will be fully apparent to those skilled in the art. As an alternative to the arrangement illustrated in FIG. 5, the heat exchanger may employ a single type of plate having the A and B type patterns alternately disposed thereon, in a manner more fully described in co-pending U.S. patent application Ser. No. 409,427 filed Aug. 19, 1982 and assigned to the assignee of the present invention, the entire disclosure of which is hereby incorporated by reference.

The patterns in accordance with the present invention thus provide a highly efficient transfer of heat energy from the hot exhaust gas to the air while at the same time providing a reduced pressure drop over the prior art heat exchange techniques. A greater amount of heat may be exchanged due to the sinusoidal parallel paths of the air and the gas through the plates as illustrated in FIG. 3, and the pressure drops created during the travel of the air and gas through and between individual plate pairs are reduced since the flows are of substantially constant area and not obstructed by transverse ridges.

While the preferred embodiments and examples of the invention have been described with reference to the foregoing specification and drawings, the scope of the invention shall now be defined with reference to the following claims.

What is claimed is:

1. A generally planar plate adapted for use in a heat exchange apparatus of the type having a plurality of such plates through which heat is exchanged from a first gas to a second gas, said plate comprising at least one pattern having a plurality of alternating spacing ridges and generally sinusoidally varying surface strips extending parallel to one another such that each of said spacing ridges is disposed between two of said surface strips, each of said surface srips defining alternating valleys and hills extending out of the plane of said plate, said valleys and hills being aligned substantially parallel to one another and substantially perpendicular to said spacing ridges, said pattern adapted to produce a generally sinusoidal flow of said first and second gases in opposite directions on opposite sides of said plate, said opposite directions being generally parallel to said surface strips.

2. The plate of claim 1 wherein said plurality of spacing ridges are disposed such that said plurality of surface strips are of substantially equal widths.

3. The plate of claim 1 wherein said plurality of spacing ridges are disposed such that all but two of said plurality of surface strips are of substantially equal width, the widths of said two surface strips being approximately one half the width of said other strips, said two surface strips being disposed on opposite sides of said surface strips of substantially equal widths.

4. The plate of claims 2 or 3 further comprising first and second sealing ridges disposed on opposite sides of said plurality of surface strips and substantially parallel to said spacing ridges, said first sealing ridge extending from one end of said pattern and terminating short of the other end of said pattern to provide an inlet for said second gas, said second sealing ridge extending from the other end of said pattern and terminating short of said one end of said pattern to provide an outlet for said second gas.

5. The plate of claim 4 further comprising third and fourth sealing ridges disposed on opposite ends of said plurality of surface sections substantially perpendicular to said spacing ridges.

6. A heat exchange apparatus having a plurality of generally planar plates through which heat is exchanged from a first gas to a second gas, wherein at least first and second of said plurality of plates are respectively provided with first and second opposing patterns each having a plurality of alternating spacing ridges and generally sinusoidally varying surface strips extending parallel to one another such that each of said spacing ridges is disposed between two of said surface strips, said surface strips defining valeys and hills extending out of the plane of said plate, said valleys and hills being generally parallel to one another and perpendicualr to said spacing ridges, whereby said second gas flows in a generally sinusoidal path in a first direction generally parallel to said surface strips along a first side of said first and second plates between said first and second plates and said first gas flows in a generally sinusoidal path in a direction opposite said first direction along the other side of at least one of said first and second plates.

7. The heat exchange apparatus of claim 6 wherein said plurality of spacing ridges on said second pattern are disposed relative to said plurality of spacing ridges on said first pattern such that said plurality of spacing ridges on said second pattern lie along a line substantially along the middle of said plurality of surface strips of said first pattern, and said plurality of spacing ridges on said first pattern lie along a line substantially in the middle of said surface strips of said second pattern.

8. The heat exchange apparatus of claim 7 wherein said first and second patterns are each provided with first and second sealing ridges disposed on opposite sides of said plurality of surface strips and substantially parallel to said spacing ridges, said first sealing ridges extending from one end of each of said first and second patterns and terminating short of the other end of said first and second patterns to provide an inlet for said second gas, said second sealing ridges extending from the other ends of said first and second patterns and terminating short of said one of said first and second patterns to provide an outlet for said second gas, said first and second sealing ridges on said first pattern abutting said first and second sealing ridges on said second pattern, respectively, when said first and second of said plurality of plates are mounted in said heat exchange apparatus, said second gas flowing from said inlet to said outlet between said first and second plates.

9. The heat exchange apparatus of claim 8, wherein said first and second patterns each further comprise third and fourth sealing ridges disposed on opposite ends of said plurality of surface sections substantially perpendicular to said spacing ridges.

10. A heat exchange apparatus made up of a plurality of generally planar plates of substantially uniform extent and of relatively thin material so formed and stacked as to provide heat transfer through said plates from a first gas to a second gas, said plates being of substantially identical size and being of two types, the first of which is formed with a central opening and an alternating arrangement of first surface patterns and ports, the second of which is formed with a central opening and an alternating arrangement of second surface patterns and ports, said first and second types of plates being stacked alternately so as to place said ports and patterns in alignment, with surface patterns of the first type on plates of said first type being adjacent to surface pattens of the second type on a plate of said second type adjacent thereto to form a plurality of opposing pattern pairs, each of said first and second patterns in each pattern pair having a plurality of alternating spacing ridges and sinusoidally varying surface strips extending parallel to one another such that each of said spacing ridges is disposed between two of said surface strips, each of said surface strips defining alternating valleys and hills extending out of the plane of said plate, said valleys and hills being formed substantially parallel to one another and substantially perpendicular to said spacing ridges, whereby said second gas flows in a generally sinusoidal path in a first direction generally parallel to said surface strips along a first side of said first and second plates and said first gas flows in a generally sinusoidal path in a direction opposite said first direction along the other side of at least one of said first and second plates.

11. The heat exchange apparatus of claim 10 wherein said plurality of spacing ridges on said second pattern in each pattern pair are disposed relative to said plurality of spacing ridges on said first pattern such that said plurality of spacing ridges on said second pattern lie along a line substantially along the middle of said plurality of surface strips of said first pattern, and said plurality of spacing ridges on said first pattern lie along a line substantially in the middle of said surface strips of said second pattern.

12. The heat exchange apparatus of claim 11 wherein said first and second patterns in each pattern pair are each provided with first and second sealing ridges disposed on opposite sides of said plurality of surface strips and substantially parallel to said spacing ridges, said first sealing ridges extending from one end of each of said first and second patterns and terminating short of the other end of said first and second patterns to provide an inlet for said second gas, said second sealing ridges extending from the other ends of said first and second patterns and terminating short of said one end of said first and second patterns to provide an outlet for said second gas, said first and second sealing ridges on said first pattern abutting said first and second sealing ridges on said second pattern, respectively, said second gas flowing from said inlet to said outlet between said first and second plates.

13. The heat exchange apparatus of claim 12, wherein said first and second patterns in each pattern pair each further comprise third and fourth sealing ridges disposed on opposite ends of said plurality of surface sections substantially perpendicular to said spacing ridges.

14. The heat exchange apparatus of claims 6 or 10 wherein said first and second plates abut each other such that said first and second patterns intersect at the grid of points which function to maintain said patterns a predetermined distance from each other.

15. The heat exchange apparatus of claims 6 or 10 wherein said generally sinusoidal paths are of substantially constant cross sectional area between said first and second patterns but have substantially varied shapes along said paths.

16. A heat exchange apparatus having a plurality of plates through which heat is exchanged from a first gas to a second gas, wherein at least first and second of said plurality of plates are respectively provided with first and second abutting and opposing patterns each having a plurality of parallel generally sinusoidally varying surface strips and a grid of support points disposed at spaced intervals intermediate said surface strips, said support points being adapted to maintain said first and second plates a predetermined distance from each other, whereby said second gas flows in a generally sinusoidal path of substantially constant cross sectional area but varying shape in a first direction which is generally parallel to said surface strips along a first side of said first and second plates between said first and second plates and said first gas flows in a generally sinusoidal path of substantially constant cross sectional area but varying shape in a direction opposite said first direction along the other side of at least one of said first and second plates.

* * * * *